US007621377B2

(12) United States Patent
Husmann

(10) Patent No.: US 7,621,377 B2
(45) Date of Patent: Nov. 24, 2009

(54) ELEVATOR WITH VERTICAL VIBRATION COMPENSATION

(75) Inventor: Josef Husmann, Luzern (CH)

(73) Assignee: Inventio AG, Hergiswil NW (CH)

( * ) Notice: Subject to any disclaimer, the term of this patent is extended or adjusted under 35 U.S.C. 154(b) by 469 days.

(21) Appl. No.: 11/387,665

(22) Filed: Mar. 23, 2006

(65) Prior Publication Data

US 2006/0243538 A1 Nov. 2, 2006

(30) Foreign Application Priority Data

Mar. 24, 2005 (EP) ..... 05102382

(51) Int. Cl.
*B66B 1/34* (2006.01)

(52) U.S. Cl. ..... 187/292; 187/394; 187/406

(58) Field of Classification Search ..... 187/258, 187/292, 315, 393, 394, 409, 410, 406
See application file for complete search history.

(56) References Cited

U.S. PATENT DOCUMENTS

| | | | | |
|---|---|---|---|---|
| 2,052,690 | A * | 9/1936 | Austin | 187/249 |
| 4,030,570 | A | 6/1977 | Caputo | |
| 4,269,286 | A * | 5/1981 | Ishii et al. | 187/292 |
| 4,416,352 | A * | 11/1983 | Husson et al. | 187/297 |
| 5,027,925 | A * | 7/1991 | Kahkipuro | 187/292 |
| 5,308,938 | A * | 5/1994 | Roberts et al. | 187/393 |
| 5,544,721 | A * | 8/1996 | Roberts | 187/394 |
| 5,824,975 | A * | 10/1998 | Hong | 187/292 |
| 5,828,014 | A * | 10/1998 | Goto et al. | 187/292 |
| 5,955,709 | A | 9/1999 | Traktovenko et al. | |
| 6,311,802 | B1 * | 11/2001 | Choi et al. | 187/293 |
| 6,401,871 | B2 * | 6/2002 | Baranda et al. | 187/254 |
| 6,474,449 | B1 * | 11/2002 | Utsunomiya et al. | 187/410 |
| 2001/0037916 | A1 * | 11/2001 | Morishita | 187/277 |
| 2002/0047350 | A1 * | 4/2002 | Pal | 310/68 B |
| 2003/0111302 | A1 * | 6/2003 | Utsunomiya et al. | 187/410 |
| 2003/0192745 | A1 * | 10/2003 | Utsunomiya et al. | 187/292 |
| 2004/0020725 | A1 * | 2/2004 | Utsunomiya et al. | 187/292 |
| 2005/0145439 | A1 * | 7/2005 | Husmann et al. | 187/292 |
| 2005/0145440 | A1 * | 7/2005 | Husmann et al. | 187/292 |

FOREIGN PATENT DOCUMENTS

| | | |
|---|---|---|
| EP | 1 469 021 | 9/2004 |
| GB | 284 387 A | 1/1928 |
| GB | 284387 | 1/1928 |
| JP | 3-018577 A | 1/1991 |
| JP | 2002-087722 A | 3/2002 |
| JP | 2002087722 | 3/2002 |

* cited by examiner

*Primary Examiner*—Bentsu Ro
*Assistant Examiner*—Kawing Chan
(74) *Attorney, Agent, or Firm*—Fraser Clemens Martin & Miller LLC; William J. Clemens

(57) ABSTRACT

An elevator has a car traveling along guide rails within a hoistway and a main drive propelling the car. A sensor mounted on the car measures a vertical travel parameter of the car, a comparator compares the sensed car travel parameter with a reference value derived from the main drive, and an auxiliary motor mounted on the car exerts a vertical force on at least one of the guide rails in response to an error signal output from the comparator.

10 Claims, 7 Drawing Sheets

ELEVATOR WITH VERTICAL VIBRATION COMPENSATION

BACKGROUND OF THE INVENTION

The present invention relates to elevators and, in particular, to a device for reducing transient vertical vibration acting on an elevator car.

A common problem associated with most elevators is that of low frequency vertical vibration of the elevator car. This phenomenon is principally due to the inherent elasticity of the main drive system used to propel and support the car within the hoistway; for example the compressibility of the working fluid used in hydraulic elevators and the elasticity of the rope used in traction elevators. Accordingly, any fluctuation in the force acting on the car will cause transient vertical vibration about a steady-state displacement of the car. The predominant frequency of these vibrations is that of the fundamental mode of vibration which is dependent on the travel height of the elevator and, for a traction elevator, the type of rope used. For a traction elevator having a travel path of 400 m and using steel ropes the fundamental frequency can be less than 1 Hz. Vibrations at such low frequencies are easily perceptible to passengers, undermining passenger confidence in the safety of the elevator and generally leading to deterioration in perceived ride quality.

There are two general sources of vibration, namely:

a) those due to fluctuations in the load of the car caused by embarkation and disembarkation of passengers while the car is held stationary by the drive at a landing; and b) vibrations during travel caused by car overshoot during jerk phases of the drive, interference with other components within the elevator hoistway (wind forces due to passage of the car past shaft doors and neighboring cars within the hoistway, counterweight crossing, etc.) and movement of passengers within the traveling car.

The effects of the first of these sources of vibration are discussed in and addressed by European patent document EP 1 460 021 A1 where friction shoes mounted on the car are brought into contact with guide rails when the car is at rest at a landing. Hence, the overall damping ratio of the system is increased and the transient vibrations due to load fluctuations as passengers embark and disembark the car are attenuated more quickly. However, this solution is only applicable to a stationary elevator car and cannot solve the vibration experienced by a passenger in a traveling elevator car.

Furthermore, if the steady-state displacement of the car from the landing due to the change in the load is above a specific value, it may be necessary to perform a conventional re-leveling operation whereby the main drive is employed to make a small trip and thereby bring the car back to the level of the landing. The use of the main drive in this fashion, particularly since the car and landing doors are open, obviously presents an unwanted safety risk to passengers. The steady-state displacement must be determined before the re-leveling operation can commence, hence it necessarily has a slow reaction time. Furthermore, the re-leveling operation itself excites further low frequency vibrations.

One of the sources of vibration while the car is traveling is jerk phases in the travel curve of the drive. When a typical acceleration command generated by the elevator controller is fed directly into the motor of the main drive, there tends to be some overshoot in the car's response producing jerk and unwanted vibrations as shown by the first response curve R1 in FIG. 1. A conventional method of reducing the vibrations in the response is to compensate by rounding of the jerk as show by travel curve trajectory R2. However, this compensation of the response always increases travel time and therefore reduces the transport capacity of the elevator.

Furthermore, such compensation cannot solve the problem of vibrations induced by interference of the traveling car with other components within the elevator hoistway and movement of passengers within the car. In a traction elevator having a traction sheave driving a rope interconnecting the car and a counterweight, the sheave acts as a node in the fundamental mode of vibration particularly when the car is in the middle section of the hoistway and therefore has no influence whatsoever on the amplitude of the predominant fundamental vibrations experienced by the car. Until recently, this problem was not particularly disturbing to passengers traveling in the car since the ropes were relatively stiff being made from steel and therefore the amplitude of these vibrations was relatively small. However, with the development and subsequent deployment of synthetic ropes in traction elevators to replace traditional steel ropes, the elasticity of the ropes has approximately doubled and, for a travel path of 400 m, the fundamental frequency can be less than 0.6 Hz. This increase in elasticity combined with the decrease in the fundamental frequency makes the car much more susceptible to low frequency vertical vibrations. In particular, vibrations induced by interference of the traveling car with other components within the elevator hoistway and movement of passengers within the car are no longer a problem that can be disregarded since they will be increasingly perceptible to passengers in the future.

SUMMARY OF THE INVENTION

Accordingly, an objective of the present invention is to reduce vertical vibrations of an elevator car.

This objective is achieved by an elevator comprising a car arranged to travel along guide rails within a hoistway, a main drive to propel the car, a sensor mounted on the car to measure a vertical travel parameter of the car, a comparator to compare the sensed car travel parameter with a reference value derived from the main drive, and an auxiliary motor mounted on the car to exert a vertical force on at least one of the guide rails in response to an error signal output from the comparator. Accordingly, any undesired vertical vibrations of an elevator car while it is stationary at a landing or traveling through the hoistway will produce an error signal from the comparator and the auxiliary motor is driven to exert a vertical frictional or electromagnetic force on the guide rail to counteract the vibrations.

Furthermore, provided that the auxiliary motor has sufficient power, when the car is stationary at a landing, the auxiliary motor can keep the car level with the landing and therefore the conventional re-leveling operation executed by the main drive is no longer required.

Preferably the elevator is a traction elevator where the main drive comprises an elevator controller, a main motor and a traction sheave engaging a traction rope interconnecting the car with a counterweight. The present invention is particularly beneficial for a traction elevator wherein the traction rope is synthetic since such installations are inherently more susceptible to low frequency vertical vibration. However, the invention is also applicable to traction elevators using belts or steel ropes, particularly when the installation is of the high-rise type.

Advantageously the error signal is fed into an auxiliary controller which outputs a force command signal to a power amplifier providing energy to the auxiliary motor. The auxiliary controller provides the necessary conditioning of the error signal to ensure effective vibration damping. The auxiliary controller may comprise a band-pass filter to suppress components of the signal having a frequency less than the fundamental frequency of the elevator to prevent any build up of steady state errors. The upper cut-off frequency of the filter can be determined by the dynamics of the control system so as to prevent high frequency jitter. Furthermore the auxiliary controller preferably contains a proportional amplifier to produce a behavior commonly known as skyhook damping. Additionally, the auxiliary controller may also comprise a differential amplifier, an integral amplifier and/or a double integral amplifier to add virtual mass to the car and virtual stiffness to the system.

Preferably the car is guided along the guide rails by roller guides, each roller guide comprising a plurality of wheels engaging with the guide rail and wherein the auxiliary motor is arranged to rotate at least one of the wheels. Many elevators already use roller guides to guide the car along the guide rails and driving one of the wheels of the roller guides with the auxiliary motor is an efficient, relatively low-cost and light-weight way of implementing the present invention.

Preferably a shaft of the driven wheel is rotatably mounted at a first point of a lever which is pivotably secured to the car at a second point and a shaft of the of the auxiliary motor is aligned with the second point with a transmission belt arranged around the shaft of the driven wheel and the auxiliary motor ensuring simultaneous rotation. With this arrangement the auxiliary motor is in a fixed position with respect to the car and accordingly the motor is not required to move with the wheel which can be subject to vibration.

In order to reduce the energy demand of the system, the auxiliary motor is preferably of a synchronous, permanent magnet type so that energy can be regenerated when the motor is decelerating the car and working as a generator and not as a motor. Ultracapacitors can be incorporated in the power amplifier to store this recovered energy for subsequent use.

The present invention also provides a method for reducing vibrations exerted an elevator car comprising the steps of providing a main drive to propel the car along guide rails within a hoistway by measuring a vertical travel parameter of the car, comparing the measured car travel parameter with a reference value derived from the main drive to give an error signal, and driving an auxiliary motor mounted on the car to exert a vertical force on at least one of the guide rails in response to the error signal. Accordingly, any undesired vertical vibrations of an elevator car will produce an error signal from the comparator and the auxiliary motor is driven to exert a vertical friction force on the guide rail to counteract the vibrations.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
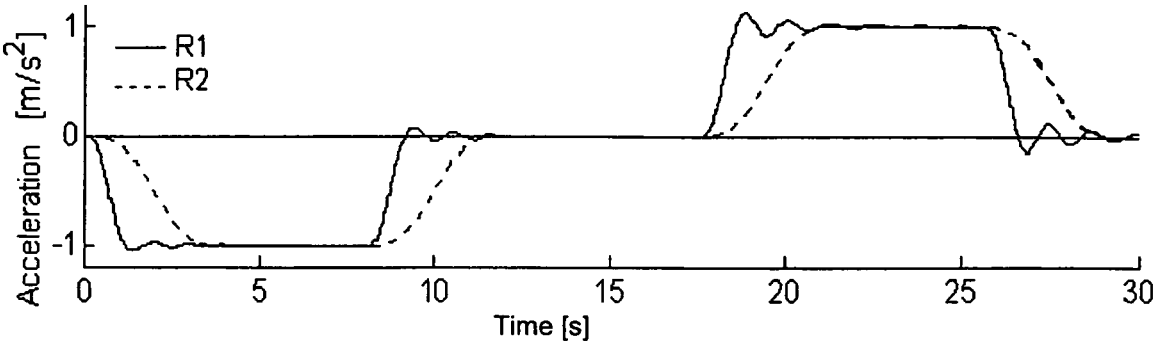
FIG. 1 is a plot of conventional travel curve responses for an elevator.

To avoid unnecessary repetition within the description, features that are common to more than one embodiment have been designated with the same reference numerals.

Figure 2:
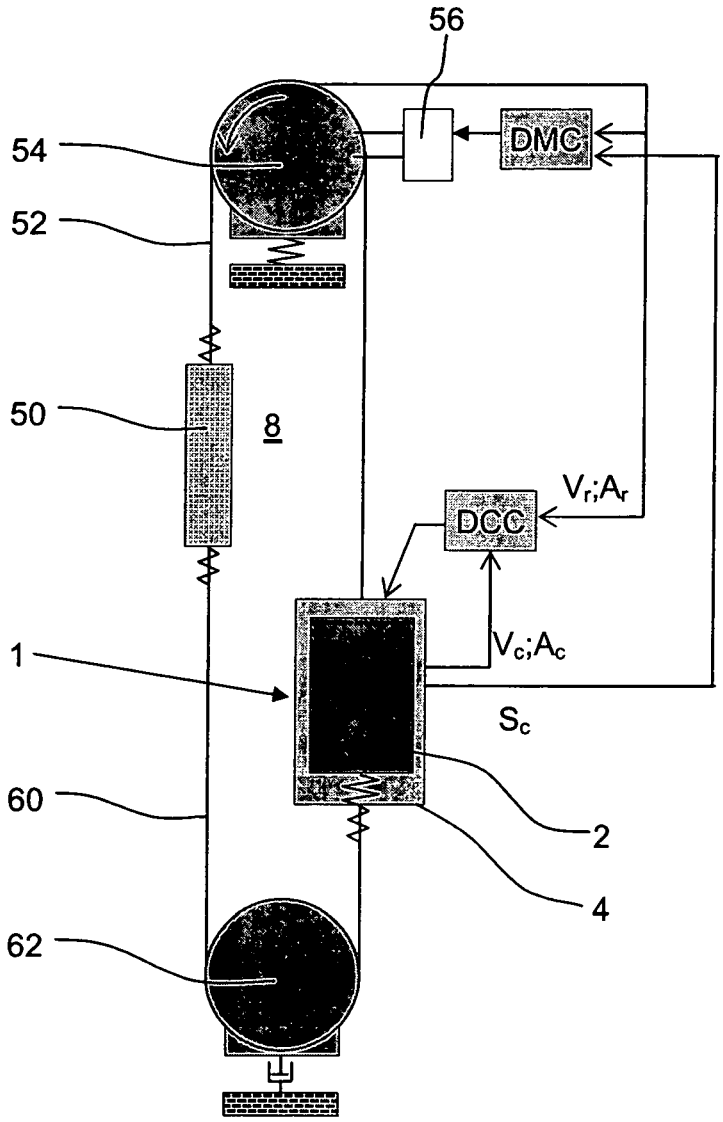
FIG. 2 is a schematic block diagram of an elevator according to the present invention.

FIG. 2 illustrates an elevator according to the present invention. The elevator includes an elevator car 1 which is arranged to travel upwards and downwards within a hoistway 8 of a building. The elevator car 1 comprises a passenger cabin 2 supported in a frame 4. A traction rope 52 interconnects the car 1 with a counterweight 50 and this rope 52 is driven by a traction sheave 54 located above or in an upper region of the hoistway 8. The traction sheave 54 is mechanically coupled to a main motor 56 which is controlled by an elevator controller DMC. The traction rope 52, the traction sheave 54, the motor 56 and the elevator controller DMC constitute the main drive used to support and propel the car 1 though the hoistway 8. In high-rise elevators the weight of the traction rope 52 is significant and a compensation rope 60 is generally provided to counteract any imbalance of the rope 52 weight as the car 1 travels along the hoistway 8. The compensation rope 60 is suspended from the counterweight 50 and the car 1 and is tensioned by a tensioning pulley 62 mounted in a lower region of the hoistway 8. A dynamic car controller DCC is provided to actuate the car 1 in response to a signal $V_c$; $A_c$ representative of the car speed or acceleration and a reference signal $V_r$; $A_r$ from the main drive. As clearly shown, there is a degree of elasticity and damping associated the traction rope 52, the compensation rope 60, the mounting of the traction sheave 54, the mounting of the tensioning pulley 62 and the mounting of the passenger cabin 2 within the car frame 4, respectively.

Figure 3:
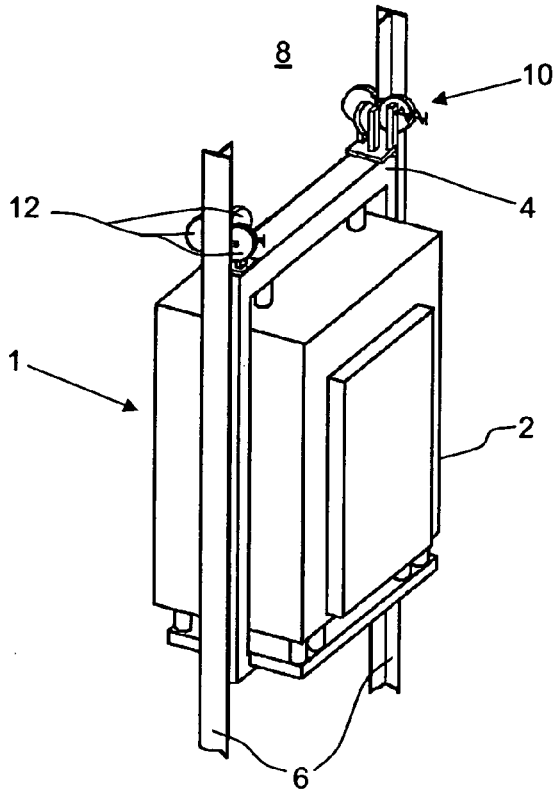
FIG. 3 is a perspective view of the elevator car of FIG. 2.

FIG. 3 is a perspective view of the car 1 shown in FIG. 2. Two roller guides 10 are mounted on top of the car frame 4 to guide the car 1 along guide rails 6 as it moves within the hoistway 8. Each roller guide 10 consists of three wheels 12 arranged to exert horizontal force on the associated guide rail 6 and thereby the car 1 is continually centralized between the opposing guide rails 6. As will be appreciated by the skilled person, a further pair of roller guides 10 can be mounted beneath the car 1 to improve the overall guidance of the car 1. A significant difference between the roller guides 10 used in the present invention and those of the prior art, is that at least one of the wheels 12 can be driven to exert a vertical frictional force F against the guide rail 6.

Figure 4:
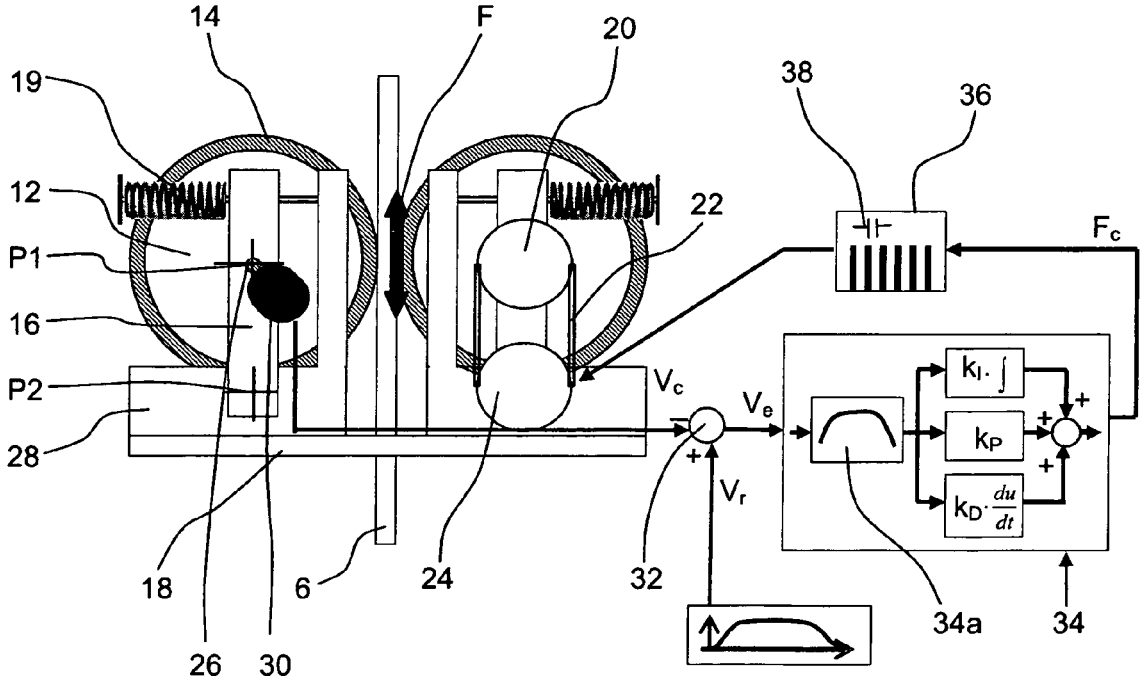
FIG. 4 is a cross-sectional view of the roller guide of FIG. 3 incorporating a speed controller.
Figure 5:
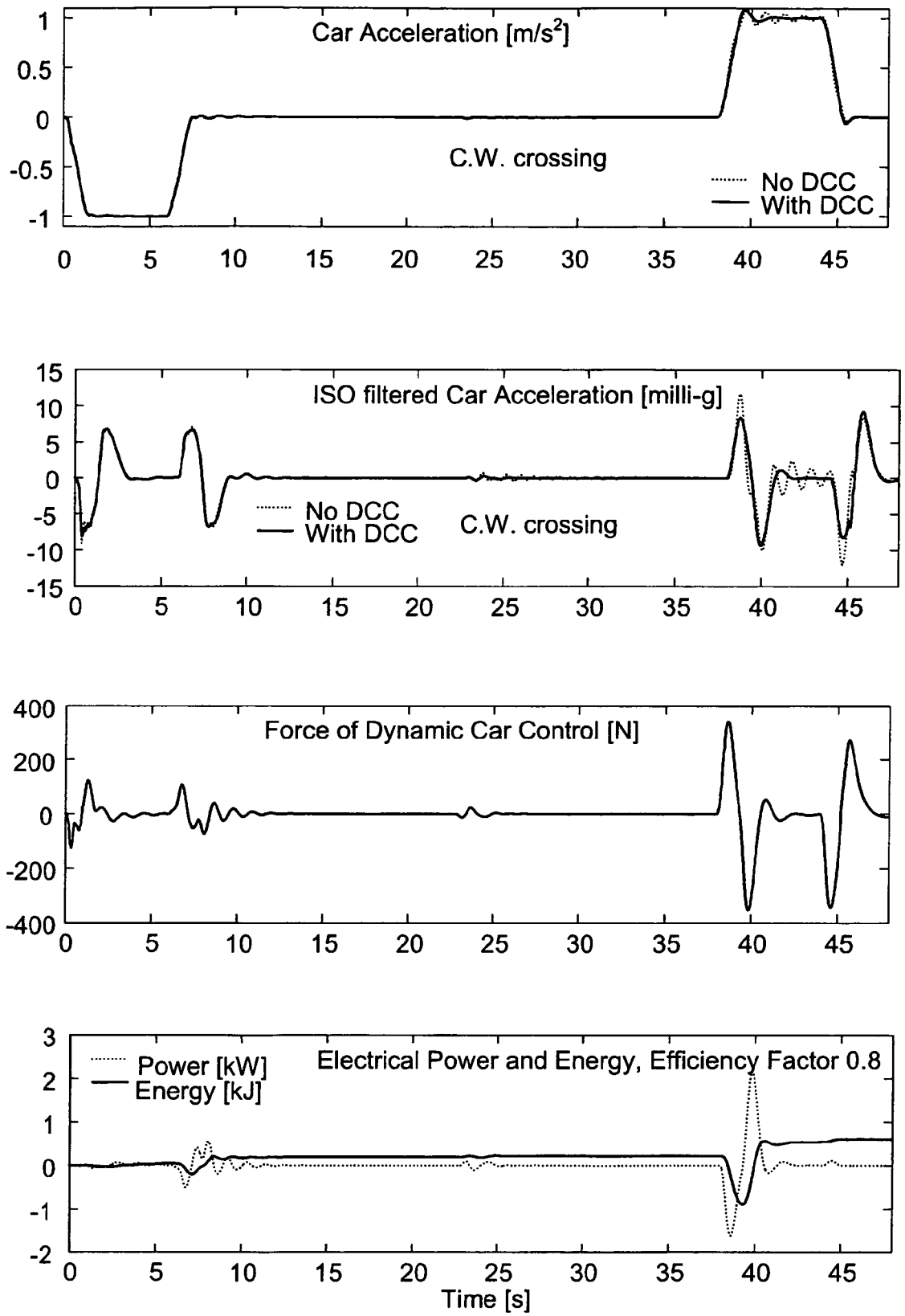
FIG. 5 is a series of plots of a first set of results obtained from simulation.
Figure 6:
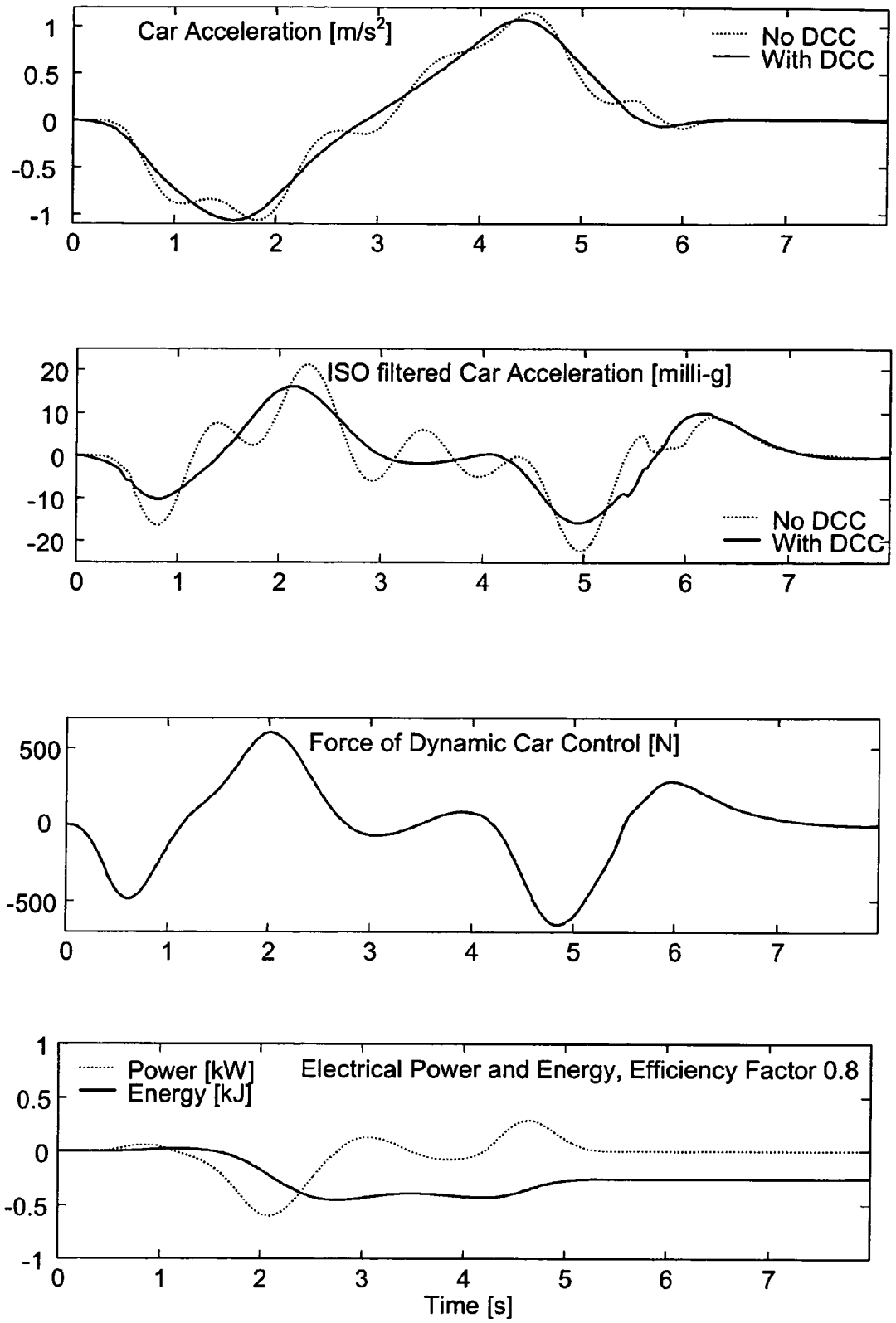
FIG. 6 is a series of plots of a second set of results obtained from simulation.
Figure 7:
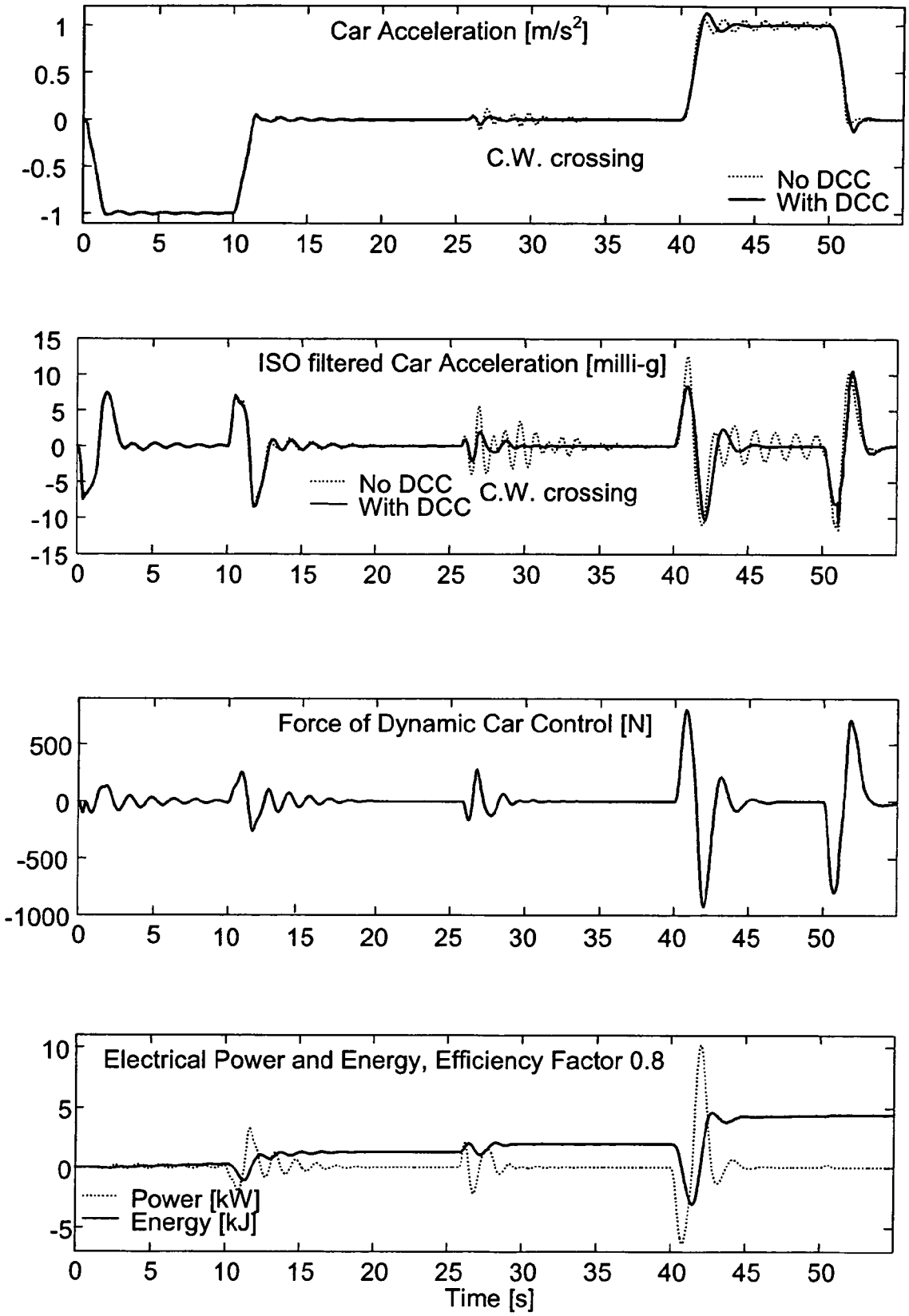
FIG. 7 is a series of plots of a third set of results obtained from simulation.
Figure 8:
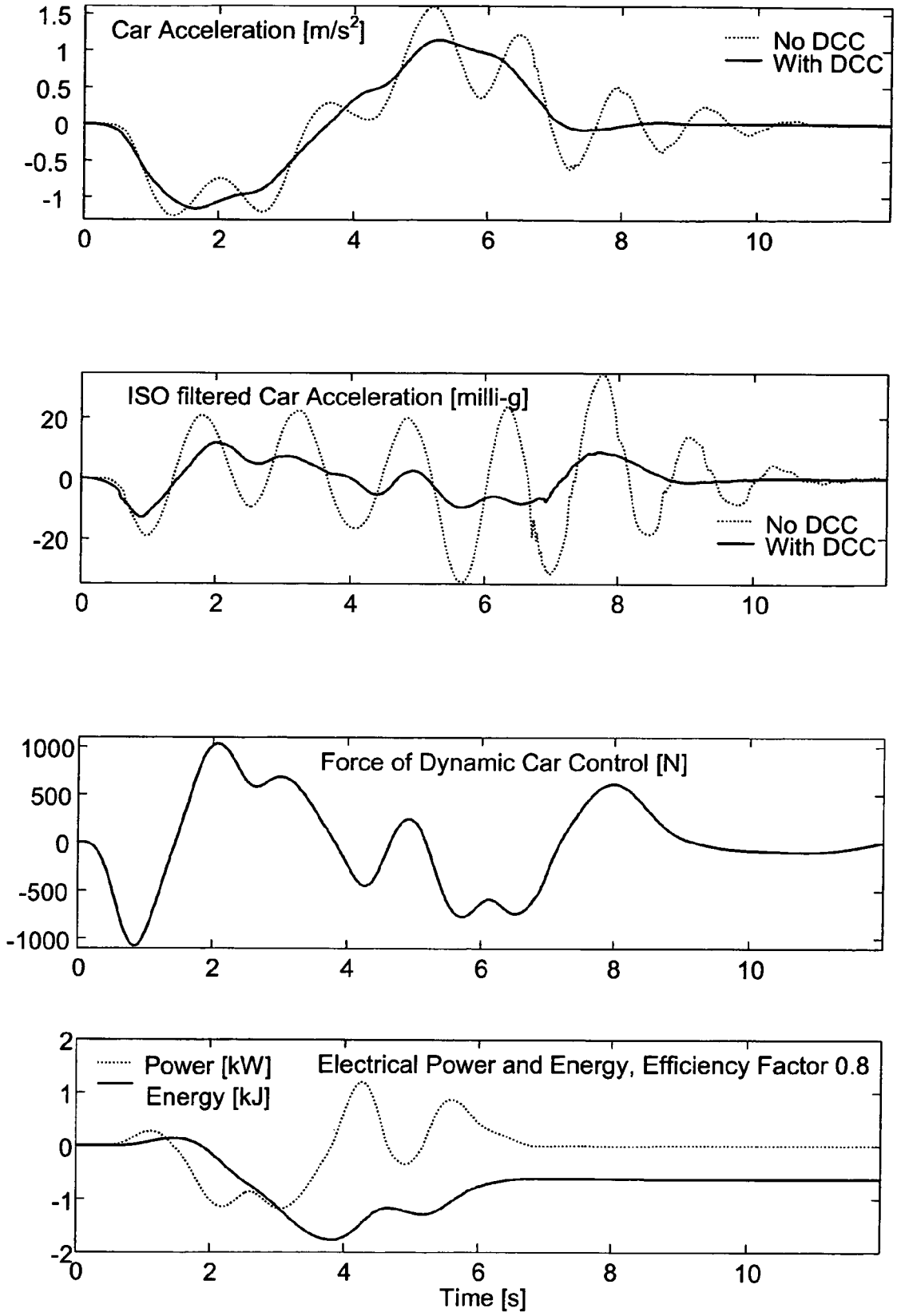
FIG. 8 is a series of plots of a fourth set of results obtained from simulation.

The structure of the roller guides 10 is shown in greater detail in FIG. 4. For clarity, the middle wheel of the roller guide 10 has been removed. Each wheel 12 has an outer rubber tire 14 engaging the guide rail 6 and has a central shaft 26 which is rotatably supported at a first point P1 on a lever 16. At its lower end, the lever 16 is pivotably supported at a second point P2 on a mounting block 28 which is fastened to a base plate 18. The base plate 18 in turn is secured to the top of the car frame 4. A compression spring 19 biases the lever 16 and thereby the wheel 12 towards the guide rail 6.

The dynamic car controller DCC of FIG. 2 will be explained with reference to the wheel 12 positioned on the right of FIG. 4. This wheel 12 is capable of being driven by an auxiliary motor 24. The auxiliary motor 24 is mounted to the base plate 18 and it is aligned with the second point P2 of the lever 16. The wheel 12 further comprises a gear pulley 20 integral with its central shaft 26. A transmission belt 22 is arranged around the pulley 20 and a second pulley (not shown) on the shaft of the auxiliary motor 24 ensuring simultaneous rotation. Preferably the gear ratio is one, however a higher gear ratio can be used to enable a reduction in the size of the auxiliary motor 24.

Although it is feasible to mount the auxiliary motor 24 directly to the shaft 26 of the guide wheel 12, this arrangement would have several disadvantages with respect to the preferred arrangement shown in FIG. 4 and described above. Firstly, such an arrangement would add further mass to the wheel 12 and consequently would impair the ability of the roller guide 10 to effectively isolate vibration between the car 1 and the guide rails 6. Furthermore, the auxiliary motor 24 itself would be subject to strong and harmful vibrations. Lastly, the arrangement would necessitate the provision of flexible wiring to the moving auxiliary motor 24.

A speed encoder 30 attached to a shaft 26 of a wheel 12 that is not driven by the motor outputs a signal $V_c$ representative of the speed of the car 1. The car speed signal $V_c$ is subtracted from a speed reference signal $V_r$ derived from the main drive at a comparator 32. A speed error signal $V_e$ resulting from this comparison is fed into a speed controller 34 mounted on the car 1. The speed error signal $V_e$ is initially passed through a band-pass filter 34*a*. The lower cut-off frequency of the filter 34*a* is less than the fundamental frequency of the elevator to compensate for rope slippage in the traction sheave 54 and to prevent any build up of steady state errors. The upper cut-off frequency of the filter 34*a* can be determined by the dynamics of the control system so as to prevent high frequency jitter. After filtering, the speed error signal $V_e$ is amplified in the speed controller 34. Proportional amplification $k_P$ is predominant in the speed controller 34 and results in a behavior commonly known as skyhook damping which is analogous to having a damper mounted between the car 1 and a virtual point which moves at the reference speed $V_r$ such that any deviations $V_e$ of the car speed $V_c$ from the reference speed $V_r$ result in the application of a force opposite and proportional to the speed deviation $V_e$. Additionally, the speed controller 34 can provide a certain amount of differential $k_D$ and integral $k_I$ amplification. Differential amplification $k_D$ adds virtual mass to the car 1 while integral amplification $k_I$ adds virtual stiffness to the system.

A force command signal $F_c$ output from the controller 34 is supplied to a power amplifier 36 which in turn drives the auxiliary motor 24 establishing a vertical frictional force F between the wheel 12 and the guide rail 6 to compensate for any deviation $V_e$ of the car speed $V_c$ from the reference speed $V_r$. Accordingly, any undesired vertical vibrations of the elevator car 1 will produce a speed error signal $V_e$ from the comparator 32 and the auxiliary motor 24 will be driven to exert a vertical friction force F between the wheel 12 and the guide rail 6 to counteract the vibrations. Furthermore, when the car 1 is stationary at a landing, the auxiliary motor 24, provided it has sufficient power, will keep the car 1 level with the landing and therefore the conventional re-leveling operation executed by the main drive is no longer required.

In order to reduce the energy demand of the system, the auxiliary motor 24 is preferably of a synchronous, permanent magnet type so that energy can be regenerated when the motor 24 is decelerating the car instead of accelerating. Ultracapacitors 38 in a dc intermediate circuit of the power amplifier 36 store this recovered energy for subsequent use. Accordingly, power drawn from the mains supply need only compensate for energy losses. These losses are proportional to the loss factor $(1/\eta-\eta)$ where $\eta$ is the combined efficiency factor of the motor 24, transmission belt 22, the friction wheel 12 and the power amplifier 36. For $\eta$=0.9, 0.8 and 0.7, the loss factor is 0.21, 0.45 and 0.73, respectively. Hence, the combined efficiency should be maintained as high as possible.

The performance of the system was evaluated using the elevator schematically illustrated in FIG. 2. The simulation was carried out for two different installations; the first having a travel height of 232 m using four aramid traction ropes 52, and the second having a travel height of 400 m employing seven aramid traction ropes 52. In both cases, the speed controller 34 employed zero integral gain $k_I$, the lower cut-off frequency of the filter 34*a* was 0.3 Hz, and the vertical frictional force F developed between the driven wheel 14 and the associated guide rail 6 was limited to about 1000 N. A numerical summary of the results obtained is provided in Table 1. A more detailed analysis of the results showing car acceleration and ISO filtered car acceleration (modeling human sensation to the vibration as defined in ISO 2631-1 and ISO 8041) of the conventional system against that recorded for a dynamic car control DCC system according to the present invention is shown in the graphical representations of FIGS. 5 to 8 together with the force produced and the power and energy consumption of the dynamic car control DCC system.

TABLE 1

| | | | | | |
|---|---|---|---|---|---|
| Travel height (m) | | 232 | | 400 | |
| Rated speed (m/s) | | 6 | | 10 | |
| Rated load (kg) | | 1150 | | 1600 | |
| DCC proportional gain | | 10'000 | | 15'000 | |
| DCC differential gain | | 2'000 | | 3'000 | |
| Travel sequence | | Long Trip | Short Trip | Long Trip | Short Trip |
| Figure No. | | 5 | 6 | 7 | 8 |
| ISO-Acceleration | No DCC | 11.1 | 20.8 | 11.8 | 32.1 |
| Peak R.M.S. (milli-g) | With DCC | 8.9 | 15.5 | 9.9 | 11.8 |
| ISO-Acceleration | No DCC | 2.7 | 8.5 | 3 | 14.5 |
| R.M.S. (milli-g) | With DCC | 2.7 | 7.5 | 2.6 | 5.4 |
| DCC Peak Force on Car (N) | | 350 | 660 | 930 | 1080 |
| Motor Peak Power (kW) | | 2.2 | 0.6 | 10.2 | 1.2 |
| Motor R.M.S. Power (kW) | | 0.29 | 0.18 | 1.33 | 0.49 |

The results clearly illustrate that the dynamic car controller DCC reduces the amplitude of any vibrations exerted on the car 1 during travel and also shortens the time taken to extinguish those vibrations, especially for short trips (FIGS. 6 and 8) which inherently are more susceptible to low frequency vibration and excitation of the fundamental mode of vibration.

Figure 9:
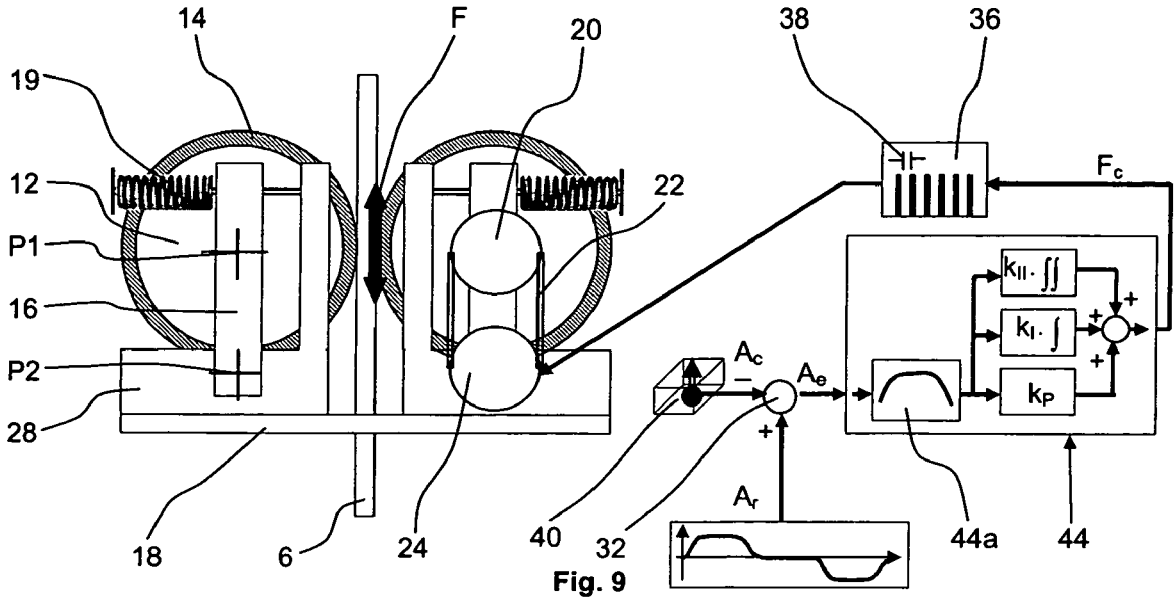
FIG. 9 is similar to FIG. 4 but uses an acceleration controller instead of the speed controller.

FIG. 9 illustrates an alternative embodiment of the present invention. Instead of speed, the vertical acceleration $A_c$ of the car 1 is measured by an accelerometer 40 mounted on the car 1. The signal $A_c$ from the accelerometer 40 is subtracted from an acceleration reference signal $A_r$ derived from the main drive at the comparator 32. An acceleration error signal $A_e$ resulting from this comparison is fed into an acceleration controller 44. As in the previous embodiment, the acceleration error signal $A_e$ is conditioned by a band-pass filter 44*a* and after filtering is amplified in the acceleration controller 44. The acceleration controller 44 has proportional $k_P$, integral $k_I$ and double integral $k_{II}$ amplification. Hence, it functions in a similar manner to the speed controller 34 of the previous embodiment but the quality of the signal is different and to account for this the level of filtering and amplification must be changed.

As before a force command signal $F_c$ output from the controller 44 is supplied to the power amplifier 36 which in turn drives the auxiliary motor 24 establishing the vertical frictional force F between the wheel 12 and the guide rail 6 to compensate for any deviation $A_e$ of the car acceleration $A_c$ from the reference acceleration $A_r$. Accordingly, the auxiliary motor 24 will be driven to exert a vertical friction force F between the wheel 12 and the guide rail 6 to counteract vibrations.

Furthermore, when the car 1 is stationary at a landing, the auxiliary motor 24, provided it has sufficient power, will keep the car 1 level with the landing and therefore the conventional re-leveling operation is no longer required.

The dynamic car controller DCC, whether in the form of the speed controller 34 or the acceleration controller 44, need not be fixed to the car 1 as in the previously described embodiments but can be mounted anywhere within the elevator installation. Indeed, further optimization is possible by integrating the dynamic car controller DCC with the elevator controller DMC in a single multi input multi output (MIMO) state space controller.

As is becoming increasingly common practice within the elevator industry, the traction ropes 52 can be replaced by belts to reduce the diameter of the traction sheave 54. The present invention works equally well for either of these traction media.

Furthermore, the auxiliary motor 24 of the previously described embodiments of the present invention can be a linear motor. In such an arrangement a primary of the linear motor is mounted on the car 1 with the guide rail 6 acting as a secondary of the linear motor (or vice versa). Accordingly, the electromagnetic field produced between the primary and the secondary of the linear motor can be used not only to guide the car 1 along the guide rails 6 but also to establish the required vertical force to counteract any vibrations of the car 1. This embodiment is less advantageous since currently available linear motors have low efficiency, are relatively heavy and energy recuperation is not possible.

Although the present invention has been described in relation to and is particularly beneficial for traction elevators incorporating synthetic traction ropes 52 or belts, it will be appreciated that the present invention can also be employed in hydraulic elevators. In such an arrangement the main drive comprises an elevator controller and a pump to regulate the amount of working fluid between a cylinder and ramp to propel and support the elevator car 1 within the hoistway 8.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator comprising:

a car traveling along guide rails within a hoistway;

a main drive propelling said car;

a sensor mounted on said car for measuring a vertical travel parameter of said car;

a comparator comparing said sensed car travel parameter with a reference value derived from said main drive to generate an error signal output; and an auxiliary motor mounted on said car for exerting a vertical force on at least one of the guide rails in response to said error signal output from said comparator to reduce vibrations exerted on said car.

2. The elevator according to claim 1 wherein said main drive comprises an elevator controller, a main motor and a traction sheave engaging a traction rope interconnecting said car with a counterweight.

3. The elevator according to claim 2 wherein said traction rope is formed of a synthetic material.

4. The elevator according to claim 1 wherein said error signal output is fed into an auxiliary controller which outputs a force command signal to a power amplifier providing energy to said auxiliary motor.

5. The elevator according to claim 4 wherein said auxiliary controller comprises a band-pass filter and at least one of a proportional amplifier, a differential amplifier, an integral amplifier and a double integral amplifier.

6. The elevator according to claim 4 wherein said car is guided along said guide rails by roller guides, each said roller guide comprising a plurality of wheels engaging with one of said guide rails and wherein said auxiliary motor is arranged to rotate at least one of said wheels.

7. The elevator according to claim 6 wherein a shaft of said at least one of said wheels is rotatably mounted at a first point of a lever which is pivotably secured to said car at a second point and a shaft of said auxiliary motor is aligned with the second point, further comprising a transmission belt arranged around said shaft of said at least one of said wheels and said shaft of said auxiliary motor ensuring simultaneous rotation.

8. The elevator according to claim 4 wherein said power amplifier contains at least one ultracapacitor.

9. The elevator according to claim 1 wherein said auxiliary motor is one of a synchronous, permanent magnet motor, an asynchronous motor and a dc motor

10. A method for reducing vibrations exerted on an elevator car comprising the steps of:

providing a main drive to propel the car along guide rails within a hoistway;

measuring a vertical travel parameter of the car with a sensor mounted on the car;

comparing the measured car travel parameter with a reference value derived from the main drive to generate an error signal; and driving an auxiliary motor mounted on the car to exert a vertical force on at least one of the guide rails in response to the error signal to reduce vibrations exerted on the car.

* * * * *